US011551661B2

(12) United States Patent
Song et al.

(10) Patent No.: US 11,551,661 B2
(45) Date of Patent: Jan. 10, 2023

(54) DIRECTIONAL SOUND DEVICE

(71) Applicant: KOREA INSTITUTE OF MACHINERY & MATERIALS, Daejeon (KR)

(72) Inventors: Kyungjun Song, Daejeon (KR); Shin Hur, Sejong (KR); Duck Gyu Lee, Daejeon (KR); Eun Joong Lee, Daejeon (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 143 days.

(21) Appl. No.: 16/978,879

(22) PCT Filed: Feb. 19, 2019

(86) PCT No.: PCT/KR2019/001988
§ 371 (c)(1),
(2) Date: Sep. 8, 2020

(87) PCT Pub. No.: WO2019/172556
PCT Pub. Date: Sep. 12, 2019

(65) Prior Publication Data

US 2021/0049995 A1 Feb. 18, 2021

(30) Foreign Application Priority Data

Mar. 7, 2018 (KR) ..... 10-2018-0027001

(51) Int. Cl.
*G10K 11/32* (2006.01)
*G10K 11/26* (2006.01)
(Continued)

(52) U.S. Cl.
CPC ..... *G10K 11/32* (2013.01)

(58) Field of Classification Search
CPC ..... G10K 11/32; G10K 11/18; G10K 11/26; G10K 11/36; H04R 1/34; H04R 1/32;
(Continued)

(56) References Cited

U.S. PATENT DOCUMENTS 3,685,609 A * 8/1972 Franssen ..... H04R 1/30 181/173
3,906,432 A * 9/1975 Ash ..... G10K 11/24 333/24 R
(Continued)

FOREIGN PATENT DOCUMENTS

CN 101728054 A * 6/2010
CN 111785244 A * 10/2020
(Continued)

OTHER PUBLICATIONS

International Search Report dated May 27, 2019, in connection with corresponding International Patent Application No. PCT/KR2019/001988.

*Primary Examiner* — Edgardo San Martin
(74) *Attorney, Agent, or Firm* — Hauptman Ham, LLP

(57) ABSTRACT

A directional sound apparatus includes a planar shape plate and a sound wave generator. The planar shape plate has a plurality of grooves formed on a surface of the planar shape plate. The sound wave generator is configured to radiate a sound wave to outside from the surface of the planar shape plate. A width of each of the grooves and a distance between the grooves adjacent to each other are smaller than a wavelength of the sound wave. The planar shape plate has a plurality of cell areas in which at least one groove is included. A structure of the groove included in a first cell area is different from that of the groove included in a second cell area adjacent to the first cell area, so that surface admittance in the first cell area is different from that in the second cell area.

9 Claims, 17 Drawing Sheets

(51) Int. Cl.
*G10K 11/18* (2006.01)
*G10K 11/36* (2006.01)

(58) Field of Classification Search
CPC ..... H04R 1/323; H04R 1/326; H04R 1/30; H04R 1/28; H04R 1/345; H04R 1/342
See application file for complete search history.

(56) References Cited

U.S. PATENT DOCUMENTS 4,283,606 A * 8/1981 Buck ..... H04R 1/24 181/166
4,800,983 A * 1/1989 Geren ..... H04R 1/345 381/160
6,491,134 B2 * 12/2002 Ryan ..... G10K 11/26 181/295
7,201,252 B2 * 4/2007 Nevill ..... H04R 1/345 381/345
8,929,580 B2 * 1/2015 Ohashi ..... H04R 1/22 381/345
9,451,355 B1 * 9/2016 Jankovsky ..... H04R 1/34
10,057,701 B2 * 8/2018 Jankovsky ..... H04R 1/288
2016/0157010 A1 6/2016 Oellers et al.

FOREIGN PATENT DOCUMENTS

CN 109863759 B * 6/2021 ..... H04R 1/342
KR 10-0267956 B1 10/2000
KR 10-2010-0029721 A 3/2010
KR 10-2010-0066826 A 6/2010
KR 10-1574794 B1 12/2015
KR 10-2016-0012838 A 2/2016
KR 20170064219 A * 6/2017
KR 102151358 B1 * 9/2020
KR 102214788 B1 * 2/2021
KR 102289251 B1 * 8/2021

* cited by examiner

DIRECTIONAL SOUND DEVICE

CROSS-REFERENCE TO RELATED APPLICATION

The present application is a national stage filing under 35 U.S.C § 371 of PCT application number PCT/KR2019/001988 filed on Feb. 19, 2019 which is based upon and claims the benefit of priorities to Korean Patent Application No. 10-2018-0027001, filed on Mar. 7, 2018 in the Korean Intellectual Property Office, which are incorporated herein in their entireties by reference.

BACKGROUND

1. Field of Disclosure

The present disclosure of invention relates to a directional sound apparatus, and more specifically the present inventions relates to a directional sound apparatus radiating a sound toward a predetermined direction on a planar shape surface with a long distance.

2. Description of Related Technology

Generally, an apparatus outputting a sound is omnidirectional, and thus the sound is uniformly radiated to all directions.

Thus, the sound is transmitted to people who do not want to listen to the sound.

In addition, the sound is uniformly radiated to all directions, and thus the sound is not radiated to a predetermined direction with a predetermined volume or with a long distance.

Accordingly, in sound application fields, a directional sound output, in which the sound is radiated to a predetermined direction, is very important topic for studies.

Concerning a method for outputting the directional sound, conventionally, a plurality sound generating devices is used, or a hone having a funnel shape is disposed in front of the sound generating device.

However, the above conventional methods occupy relatively larger space, and thus, a newly developed sound generating device occupying relatively smaller space and having relatively high directivity is necessary.

Regarding the prior art, Korean patent No. 10-0267956 is disclosed.

SUMMARY

The present invention is developed to solve the above-mentioned problems of the related arts. The present invention provides a directional sound apparatus.

In addition, the present invention also provides a directional sound apparatus having a planar shape surface so as to increase space efficiency.

In addition, the present invention also provides a directional sound apparatus capable of radiating a sound to a predetermined direction with a long distance, since the directional sound apparatus has a surface with a specific physical structure.

In addition, the present invention also provides a directional sound apparatus having a sinusoidal modulated admittance surface, so as to convert a surface wave to a long distance radiation wave along a predetermined direction.

In addition, the present invention also provides a directional sound apparatus having a surface with a newly designed physical structure, so as to control a radial direction and a width of the radiation.

According to an example embodiment, a directional sound apparatus includes a planar shape plate and a sound wave generator. The planar shape plate has a plurality of grooves formed on a surface of the planar shape plate. The sound wave generator is configured to radiate a sound wave to outside from the surface of the planar shape plate. A width of each of the grooves and a distance between the grooves adjacent to each other are smaller than a wavelength of the sound wave. The planar shape plate has a plurality of cell areas in which at least one groove is included. A structure of the groove included in a first cell area is different from that of the groove included in a second cell area adjacent to the first cell area, so that surface admittance in the first cell area is different from that in the second cell area.

In an example, a depth of the groove included in the first cell area may be different from that of the groove included in the second cell area adjacent to the first cell area.

In an example, a distance between the grooves adjacent to each other may be substantially same as a width of the groove. Central points of the grooves on a bottom surface may be connected to form a curve having a repeated uniform period.

In an example, the curve may be concaved from a surface of the planar shape plate, and may have a repeated wave shape.

In an example, a width of the groove included in the first cell area may be different from that of the groove included in the second cell area adjacent to the first cell area.

In an example, a distance between the grooves adjacent to each other may be substantially same as a depth of the groove. Widths of the grooves may be increased and decreased with a uniform period.

In an example, a distance between the grooves adjacent to each other in the first cell area, may be different from that between the grooves adjacent to each other in the second cell area.

In an example, a width of the groove may be substantially same as a depth of the groove. Distances between the grooves adjacent to each other may be increased and decreased with a uniform period.

In an example, surface admittance in the plurality of the cell areas may be combined to form a sinusoidal modulated admittance surface of the planer shape plate.

In an example, the surface admittance in each of the cell areas may be defined as a normal particle velocity on the surface with respect to a pressure of a sound source on the surface of each of the cell areas.

In an example, admittance of the sinusoidal modulated admittance surface may be defined as follows, $$Y = j\overline{Y}_x Y_o\left[1 + M\cos\left(\frac{2\pi x}{a}\right)\right]$$

A surface admittance in each cell area may be defined as follows, $$Y = jY_0\frac{w}{p}\tan(k_0 d)$$

Here, $\overline{Y}_x$ may be a mean constant value of a surface admittance, $Y_o$, may be a surface admittance of adjacent material, 'M' may be a depth of modulation, 'a' may be a period of modulation, '$k_0$' may be the number of waves in a free space, 'x' may be a position on the surface, 'w' may be a width of the groove, 'p' may be a distance between the grooves and 'd' may be a depth of the groove.

In an example, in forming the sinusoidal modulated admittance surface using a 2-dimensional circular plate, admittance of the sinusoidal modulated admittance surface may be $$Y = j\overline{Y}_x Y_o\left[1 + M\cos\left(\frac{2\pi r}{a}\right)\right]$$

along a radial direction. To perform the surface physically, the surface of the planar shape plate may be divided into a plurality of cell areas and the surface admittance of the plurality of the cell areas may be combined, so that the surface of the planar shape plate may be formed as the sinusoidal modulated admittance surface.

In an example, the grooves may be disposed with a concentric circle shape with respect to the sound wave generator.

In an example, the grooves may be disposed with a parallel line shape, and the sound wave generator may be disposed at a central area among the grooves.

In an example, the directional sound apparatus may further include a sound wave receiver configured to receive a sound wave incident to the surface of the planar shape plate from outside.

According to the present example embodiments, a planar shape plate is used, so that the directional sound apparatus increases a space efficiency.

In addition, the directional sound apparatus has a sinusoidal modulated admittance surface, and thus, a surface wave is converted into a long distance radiation wave along a predetermined direction. Here, the sinusoidal modulated admittance surface may be performed by designing a physical structure of a surface of the directional sound apparatus, and thus a radial direction and a radiation width of the directional sound apparatus may be easily controlled by changing the physical structure of the surface of the directional sound apparatus.

REFERENCE NUMERALS

Figure 1:
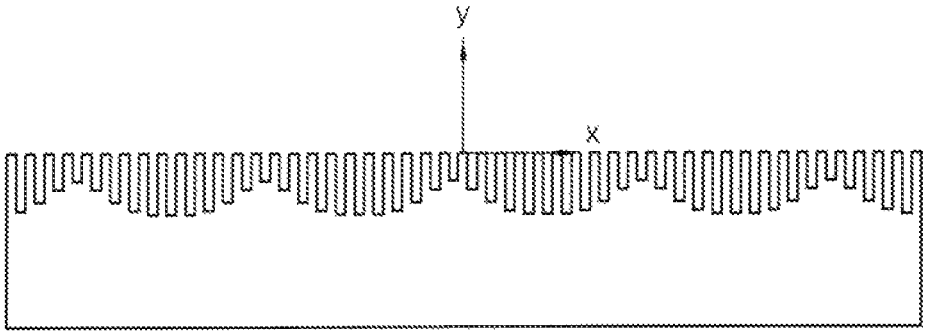
FIG. 1 is a schematic diagram defining a surface admittance.

| | |
|---|---|
| 1: directional sound apparatus | 10: planar shape plate |
| 11: groove | 20: sound wave generator |

DETAILED DESCRIPTION

The invention is described more fully hereinafter with Reference to the accompanying drawings, in which embodiments of the invention are shown.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a," "an" and "the" are intended to include the plural forms as well, unless the context clearly indicates otherwise.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity. It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

FIG. 1 is a schematic diagram defining a surface admittance. The surface admittance is defined referring to FIG. 1, and then example embodiments of the present invention will be explained in detail.

Generally, the surface admittance is defined as a reciprocal number of surface impedance, and is determined by an interaction formula between a pressure and a particle velocity on a surface.

Using the surface impedance, a load or a resistance, and a phase difference between the pressure and the particle velocity may be obtained, and thus, an amount of flows reversed to a flow of the particle velocity when the pressure is applied on the surface.

Thus, the same information mentioned above may be obtained by the surface admittance by reversing the surface impedance.

Accordingly, the surface admittance is defined as Equation 1, which means a normal particle velocity with respect to a sound pressure at a surface.

$$Surface admittance = \frac{normal particle velocity at surface}{sound pressure at surface} \quad \text{Equation 1}$$

Here, the surface admittance may be defined as Equation 2, which means a normal particle velocity at a surface of y=0, with respect to a sound pressure at a surface of y=0.

$$Surface admittance = \frac{normal particle velocity (at y = 0)}{sound pressure (at y = 0)} \quad \text{Equation 2}$$

Figure 2:
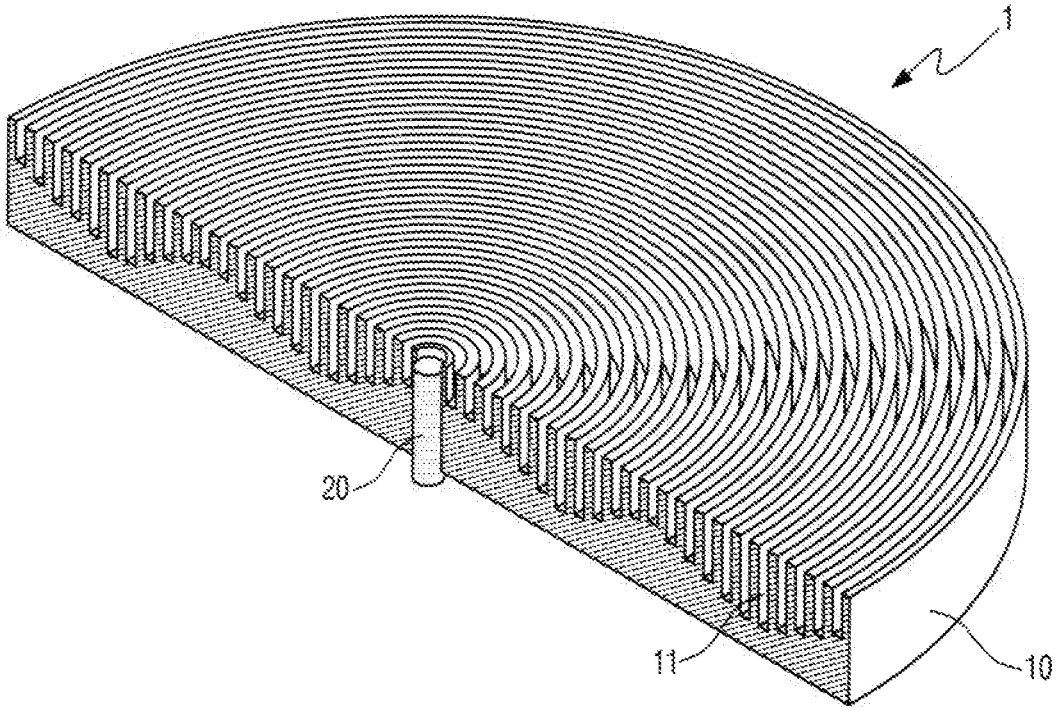
FIG. 2 is a partially perspective view illustrating a directional sound apparatus having a sinusoidal modulated admittance surface along a radial shape direction, according to an example embodiment of the present invention.
Figure 3:
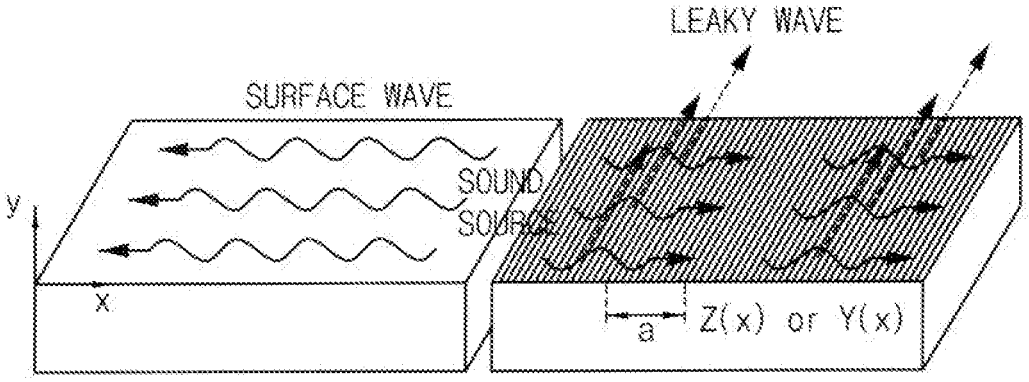
FIG. 3 shows advancing of a surface wave on a surface without a sinusoidal modulation, and converting of a surface wave into a long distance radiation wave due to the sinusoidal modulated admittance surface along an X direction.
Figure 4:
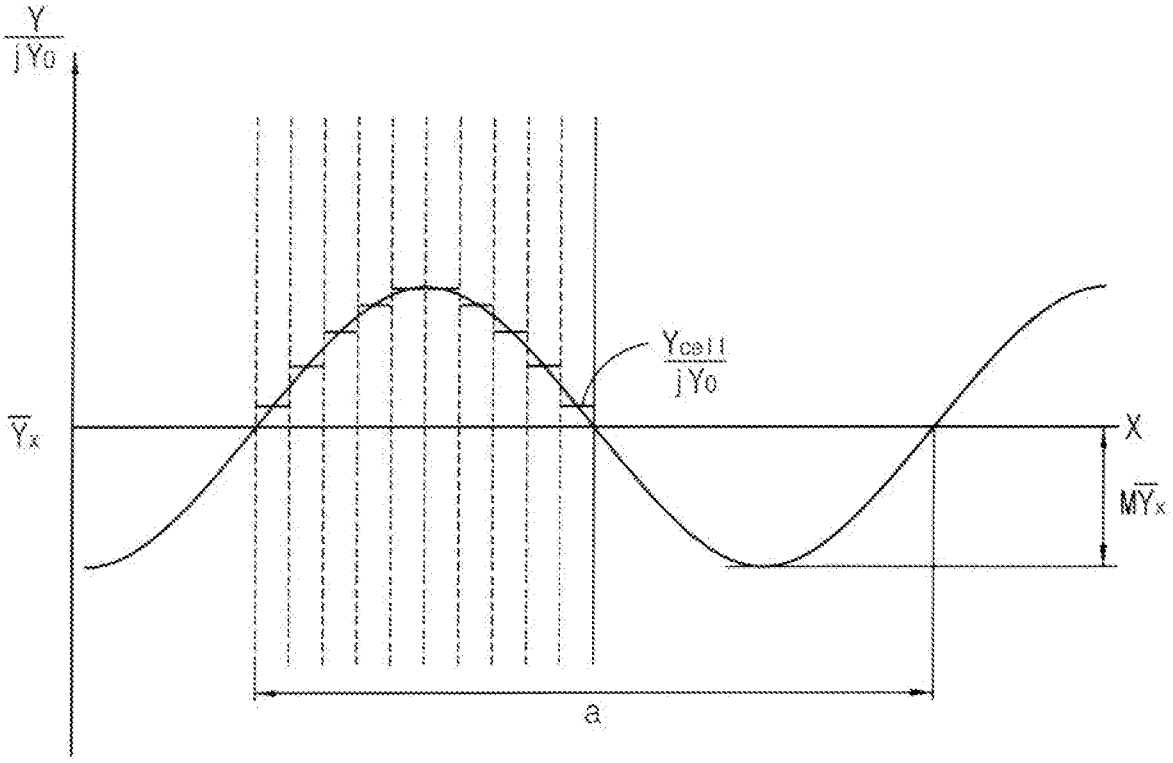
FIG. 4 is a graph showing a dividing the sinusoidal modulated admittance of a surface of a planar shape plate into a value of each cell area.
Figure 5:
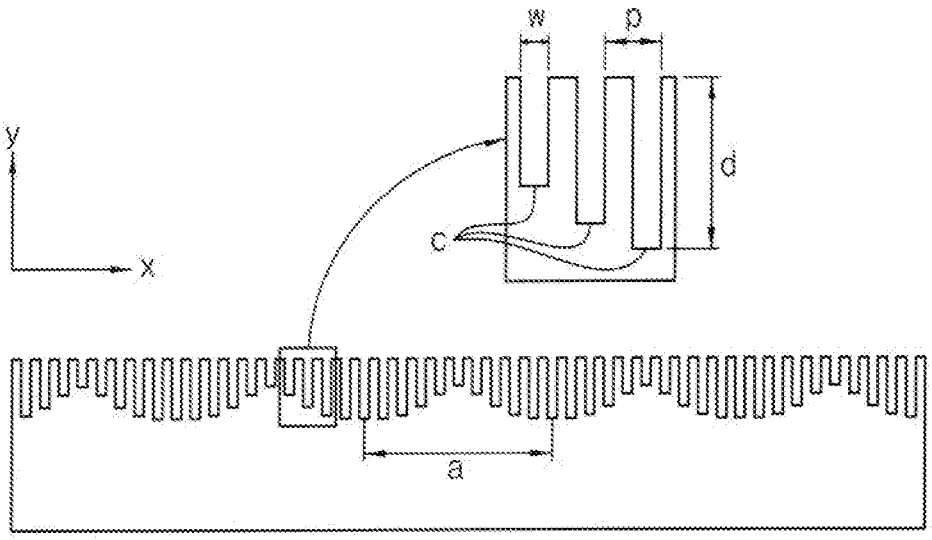
FIG. 5 is a cross-sectional shape showing an example groove structure formed to perform the sinusoidal modulated admittance of the surface of the planar shape plate.

FIG. 2 is a partially perspective view illustrating a directional sound apparatus having a sinusoidal modulated admittance surface along a radial shape direction, according to an example embodiment of the present invention. FIG. 3 shows advancing of a surface wave on a surface without a sinusoidal modulation, and converting of a surface wave into a long distance radiation wave due to the sinusoidal modulated admittance surface along an X direction. FIG. 4 is a graph showing a dividing the sinusoidal modulated admittance of a surface of a planar shape plate into a value of each cell section. FIG. 5 is a cross-sectional shape showing an example groove structure formed to perform the sinusoidal modulated admittance of the surface of the planar shape plate.

Referring to FIG. 2, the directional sound apparatus 1 according to the present example embodiment is illustrated.

The directional sound apparatus 1 according to the present example embodiment includes a planar shape plate 10 and a sound wave generator 20 radiating a sound wave to outside from a surface of the planar shape plate 10.

The planar shape plate 10 is illustrated in FIG. 2, as a half-circular plate having a predetermined height, but the planar shape plate 10 may have a circular plate having a predetermined height.

Thus, the sound wave generator 20 is disposed at a center of the planar shape plate 10.

For example, the sound wave generator 20 according to the present example embodiment may have a groove structure with a wave shape, as illustrated in FIG. 2, to perform a sinusoidal modulated admittance surface along a radial direction.

Generally, as illustrated in a left portion of FIG. 3, when the sound wave is radiated from the planar shape plate, the sound wave is omnidirectional, so that the sound from an omnidirectional sound generator is radiated to all direction uniformly.

In contrast, as illustrated in a right portion of FIG. 3, a surface wave is converted to a specific directional far field wave, due to the sinusoidal modulated admittance surface along an X direction, and thus, the sound wave from the sound wave generator 20 may be transmitted to the specific direction and may get an increased gain compared to the conventional method.

Accordingly, in the planar shape plate 10 according to the present example embodiment, as illustrated in FIG. 2, a plurality of grooves 11 is formed on the surface of the planar shape plate 10. Here, a distance between the grooves adjacent to each other is smaller than a wavelength of the sound wave, and a width of each of the grooves is also smaller than the wavelength of the sound wave. Thus, the surface of the planar shape plate 10 is formed to be the sinusoidal modulated admittance surface, so that the sound wave from the sound wave generator 20 is transmitted to a predetermined specific direction.

Here, the directional sound apparatus according to the present example embodiment may be performed as a speaker, a long distance supersonic sensor, an acoustic micro fluid device, a sonar and so on, based on the kinds of the sound wave radiated from the sound wave generator 20. The directional sound apparatus 1 according to the present example embodiment may further include a sound wave receiver receiving the sound wave incident to the surface of the planar shape plate 10.

In the directional sound apparatus 1 according to the present example embodiment, the surface of the planar shape plate 10 mathematically has a sinewave shape surface admittance, like Equation 3 as follows.

$$Y = j\overline{Y}_x Y_o\left[1 + M\cos\left(\frac{2\pi r}{a}\right)\right] \quad \text{Equation 3}$$

Here, $\overline{Y}_x$ is a mean constant value of a surface admittance, $Y_o$ is a surface admittance of adjacent material, 'M' is a depth of modulation, 'a' is a period of modulation, and 'r' is a position on the surface along the radial direction.

The surface of the planar shape plate 10 has an open guide shape structure acoustically, and the surface wave of the planar shape plate 10 is converted to a long distance radiation wave along a predetermined specific direction, due to the sinusoidal modulated admittance surface (SMAS). Then, the surface wave of the planar shape plate 10 is induced to a high gain surface sound antenna.

In the directional sound apparatus 1, the surface of the planar shape plate 10 is divided by a plurality of cell areas, and the surface admittance of the plurality of the cell areas are combined, so that the surface of the planar shape plate 10 is to be physically performed as the sinusoidal modulated admittance surface, mathematically.

For example, as illustrated in FIG. 4, to perform the above-mentioned sinusoidal modulated admittance value 'Y', the cell areas are formed by a plurality of structures different from each other, and here, each of the structures is much smaller than a wavelength of the sound wave and each of the cell areas may include at least one structure. Then, each cell area should have a mean admittance value 'Y' corresponding to the each cell area.

Thus, in the directional sound apparatus 1 according to the present example embodiment, as illustrated in FIG. 5, each cell area has a single groove, and the surface admittance 'Y' of each cell area having the single groove may be expressed by Equation 4 as follows.

$$Y = jY_0\frac{w}{p}\tan(k_0 d) \qquad \text{Equation 4}$$

Here, $Y_o$ is a surface admittance of adjacent material, 'w' is a width of the groove, 'p' is a distance between the grooves adjacent to each other, '$k_0$' is the number of waves in a free space, and 'd' is a depth of the groove.

In the directional sound apparatus 1 satisfying Equation 3 and Equation 4, the depth of the groove 'd' is increased and decreased with a constant period, when the width of the groove 'w' and the distance between the grooves 'p' are constantly maintained.

As illustrated in FIG. 5, the depths of the grooves 'd' are increased and decreased, so that bottom surfaces of the grooves adjacent to each other are connected, to form a curved surface repeated with a constant period 'a'.

For example, as illustrated in FIG. 5, the depths of the grooves are increased and decreased, so that central points 'c' at the bottom surfaces of the grooves are connected to form a curve repeated with a constant period 'a'. Here, FIG. 5 is illustrated as a cross-sectional view for the convenience of explanation, and thus, even though the curve repeated with the constant period is illustrated when the central points are connected in FIG. 5, central lines passing through the central points of the bottom surfaces are connected to form the curved surface repeated with the constant period, in the directional sound apparatus 1 according the present example embodiment.

In addition, the curved surface formed as mentioned above, has a concave shape which is depressed inside from the surface of the planar shape plate. The curved surface has a wave shape repeated with the constant period 'a', on the whole.

Figure 6:
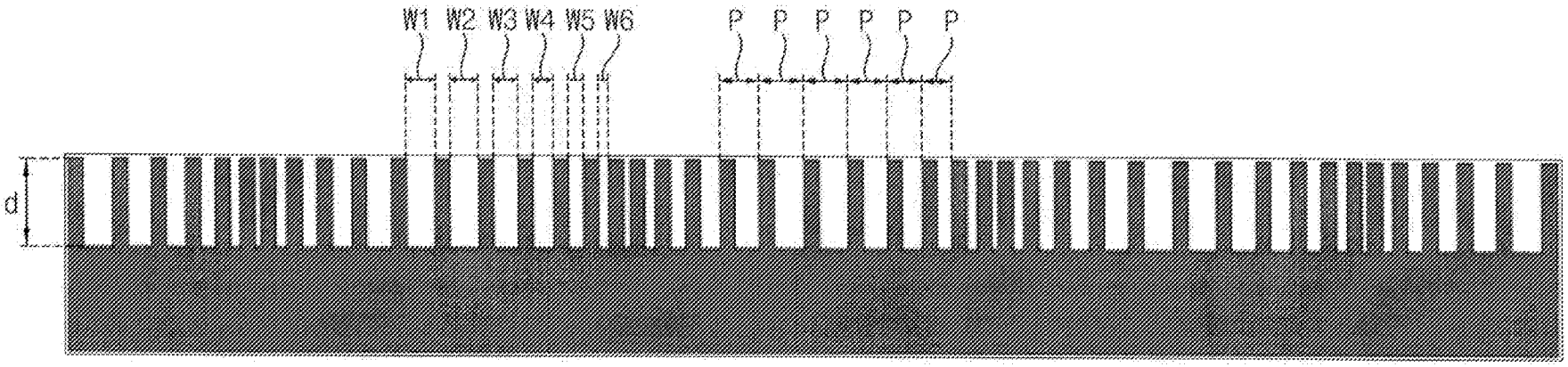
FIG. 6 is a cross-sectional shape showing another example groove structure formed to perform the sinusoidal modulated admittance of the surface of the planar shape plate.
Figure 7:
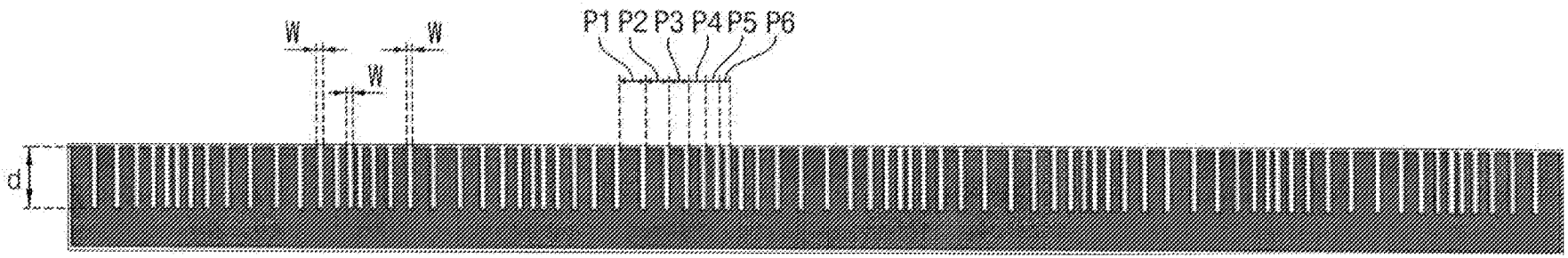
FIG. 7 is a cross-sectional shape showing still another example groove structure formed to perform the sinusoidal modulated admittance of the surface of the planar shape plate.

The shape or structure of the groove for performing the sinusoidal modulated admittance may be variously formed, and example groove structures are illustrated in FIG. 6 and FIG. 7.

FIG. 6 is a cross-sectional shape showing another example groove structure formed to perform the sinusoidal modulated admittance of the surface of the planar shape plate.

Referring to FIG. 6, in the directional sound apparatus 1 satisfying Equation 3 and Equation 4, as the depth of the groove 'd' and the distance between the grooves 'p' are uniformly maintained and the width of the groove 'w' is increased and decreased with a constant period 'a', the sinusoidal modulated admittance may be performed.

As illustrated in FIG. 6, the distance between the grooves 'p' is uniformly all over the grooves, and the width of each of the grooves w1, w2, . . . , w6 is increased and decreased with the constant period or decreased and increased with the constant period.

Here, the period, and a variation of each of the widths which is increased and decreased, may be variously changed.

FIG. 7 is a cross-sectional shape showing still another example groove structure formed to perform the sinusoidal modulated admittance of the surface of the planar shape plate.

Referring to FIG. 7, in the directional sound apparatus 1, the depth of the groove 'd' and the width of the groove 'w' are uniformly maintained, and the distance between the grooves 'p' is increased and decreased with the constant period, so that the sinusoidal modulated admittance may be performed, which may be explained by Equation 4.

As illustrated in FIG. 7, the width of the groove 'w' is uniform all over the grooves, and the distance between the grooves adjacent to each other p1, p2, . . . , p6 is increased and decreased with a constant period or decreased and increased with the constant period.

Here, the period, and a variation of each of the widths which is increased and decreased, may be variously changed.

Accordingly, the example structures of the grooves are explained above, to perform the sinusoidal modulated admittance surface. Hereinafter, for the convenience of explanation, the structure of the grooves in which the width of the groove 'w' and the distance between the grooves 'p' are uniformly maintained and the depth of the groove 'd' is increased and decreased with the constant period as illustrated in FIG. 5, will be explained in detail as the example embodiment of the directional sound apparatus 1.

However, the below explanation may also be similarly or equally applied to the structure of the grooves in which the distance between the grooves and the width of the groove are increased and decreased with the constant period.

FIG. 8A, FIG. 8B, FIG. 8C, FIG. 8D, FIG. 9A and FIG. 9B shows the characteristics of the directional sound apparatus of the present example embodiment having the groove structure of FIG. 5.

The characteristics of the sinusoidal modulated admittance surface of the directional sound apparatus 1 of the present example embodiment, may be explained referring to FIG. 8A, FIG. 8B, FIG. 8C, FIG. 8D, FIG. 9A and FIG. 9B.

Figure 8A:
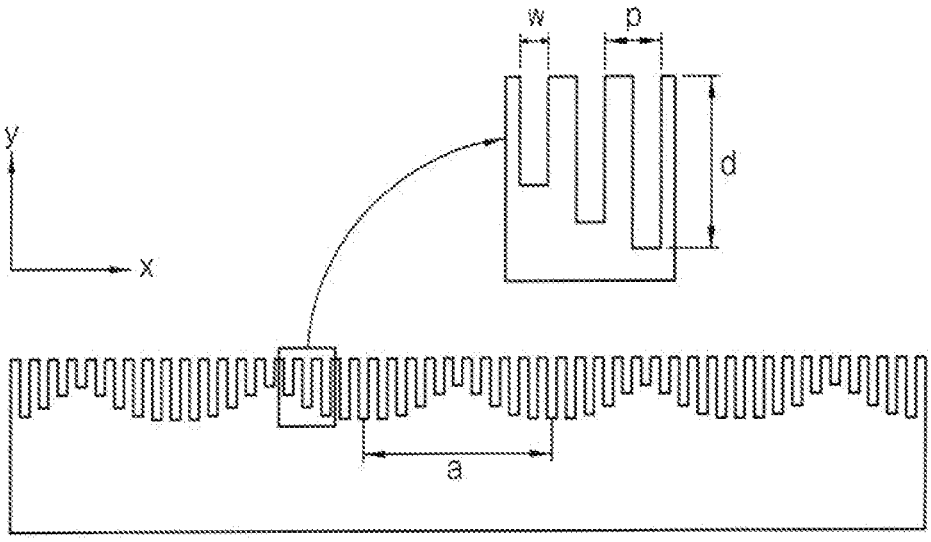
FIG. 8A, FIG. 8B, FIG. 8C, FIG. 8D, FIG. 9A and FIG. 9B shows the characteristics of the directional sound apparatus of the present example embodiment having the groove structure of FIG. 5.
Figure 8B:
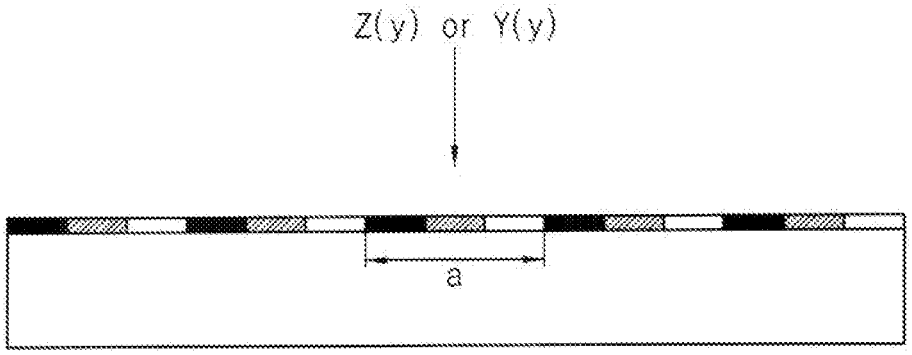

FIG. 8A shows a cross-sectional view of a sinusoidal modulated planar shape plate 10 along the X direction in an X-Y plane, and FIG. 8B shows a sine wave modulated admittance surface (SMAS) when a surface elastic wave advances along the X direction in the X-Y plane. Here, field and geometry are fixed along a Z direction which is perpendicular to the X-Y plane, and the mathematically modulated surface in the X-Y plane satisfies Equation 3 mentioned above.

Due to the above periodically modulated admittance, the number of waves transmitting along the surface of the planar shape plate may be expressed as Equation 5, which is a formula with an infinite number of a spatial frequency (or Floquet mode).

$$k_{x,n} = k_x + \frac{2n\pi}{a} \qquad \text{Equation 5}$$

Here, $k_x$ is the number of waves transmitting on the surface along the X direction.

In addition, the sinusoidal admittance modulation is a continuous fraction type and thus induces a closed type of a specific dispersion relation.

$$D_n - \frac{1}{D_{n-1-\frac{1}{D_{n-2-\cdots}}}} - \frac{1}{D_{n+1-\frac{1}{D_{n+2-\cdots}}}} = 0 \qquad \text{Equation 6}$$

Here, $$D_n = \frac{2}{M}\left[1 - \frac{j}{\overline{Y}_x}\sqrt{\frac{k_x}{k_0} + \frac{2\pi n}{k_0 a}}\right],$$

$k_x$ is the number of waves transmitting on the surface along the X direction, $k_0$ is the number of waves in a free space. From Equation 6, a guided-wave solution may be obtained, and the guided-wave solution has two type of a surface wave in which $k_x$ is a real number of β and a leaky wave in which $k_x$ is a complex number of β−jα. Here, β is a phase constant and α is a damping coefficient.

Figure 8C:
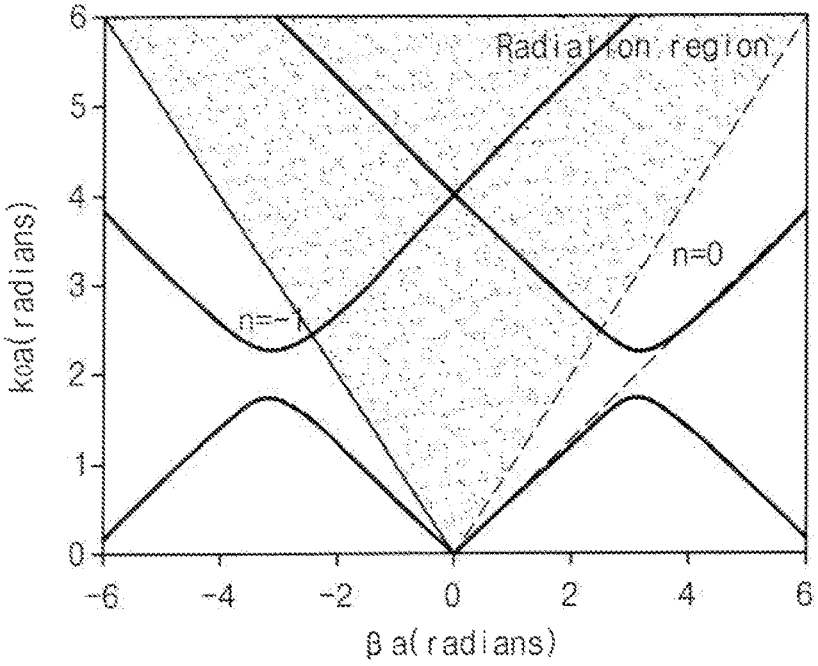

FIG. 8C shows a dispersion diagram on SMAS on a modulation factor of M=0.5, from a mean surface admittance of $\overline{Y}_x$=1.2 and Equation 6.

In M=0, the dispersion curve is expressed with a dashed line, $\beta=k_0[\sqrt{1+(\overline{Y}_x)^2}]$, and a radiation area (which is inside of a radiation angle), $\beta=k_0$, is expressed with a dashed area. Under the radiation angle, $\beta>k_0$, a curved surface mode exists according to the SMAS. An open stop band also exits around $k_0a$~2.0, due to a harmonic mode of the SMAS. A strongly limited mode in this area may be obtained from sides of a lower band or an upper band. In addition, a surface wave having a relatively higher intensity may be obtained using a high $\overline{Y}_x$. However, when $k_0a$ is over a limited value, $\beta<k_0$, other harmonic mode exists and thus one or more surface wave among surface combination modes is converted into a long distance radiation wave. In addition, as $k_0a$ increases due to the dispersion relation, a reverse direction radiation wave is converted into a forward direction radiation.

Figure 8D:
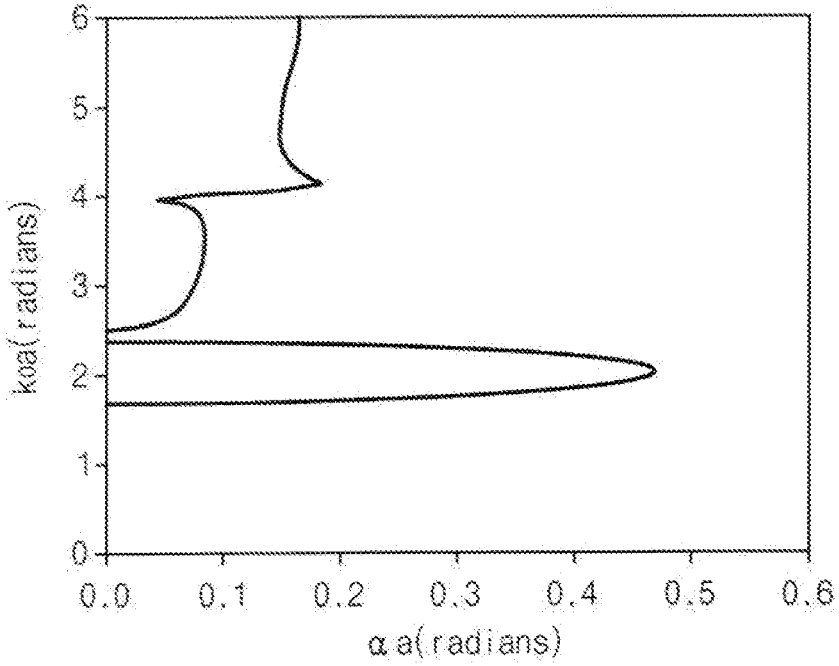

FIG. 8D shows a damping coefficient a concerning a leaking rate according to the SMAS. As expected, a relatively high damping a exists the number of waves along a vertical direction (horizontally expressed in FIG. 8D) in a stop band, which means that the guided-modes do not exist. Over the limit value of $\beta=k_0$, the number of waves $k_x$ with a type of a complex number exists due to the leakage from the SMAS.

Figure 9A:
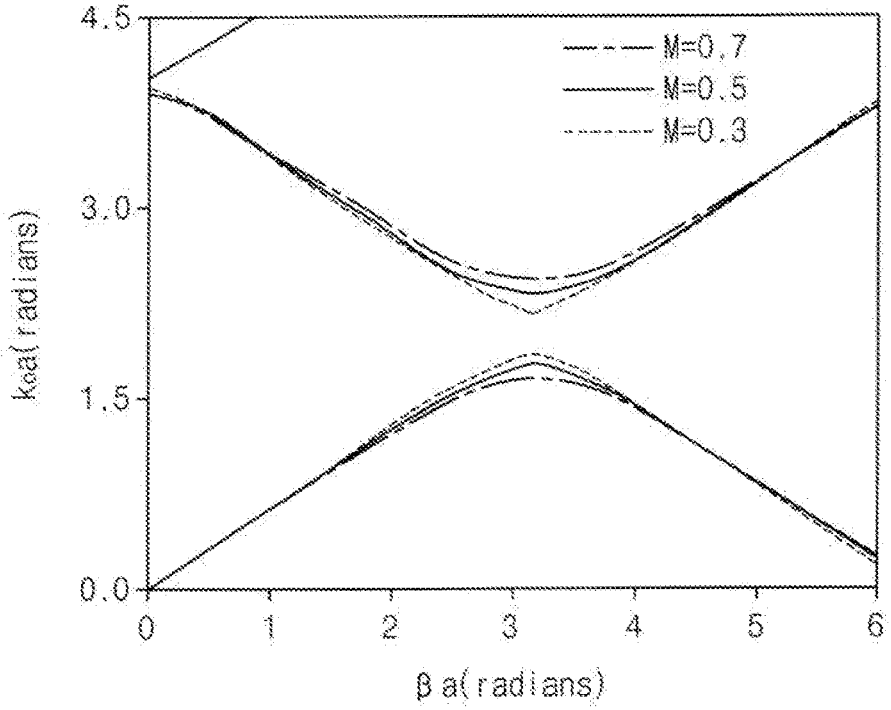
Figure 9B:
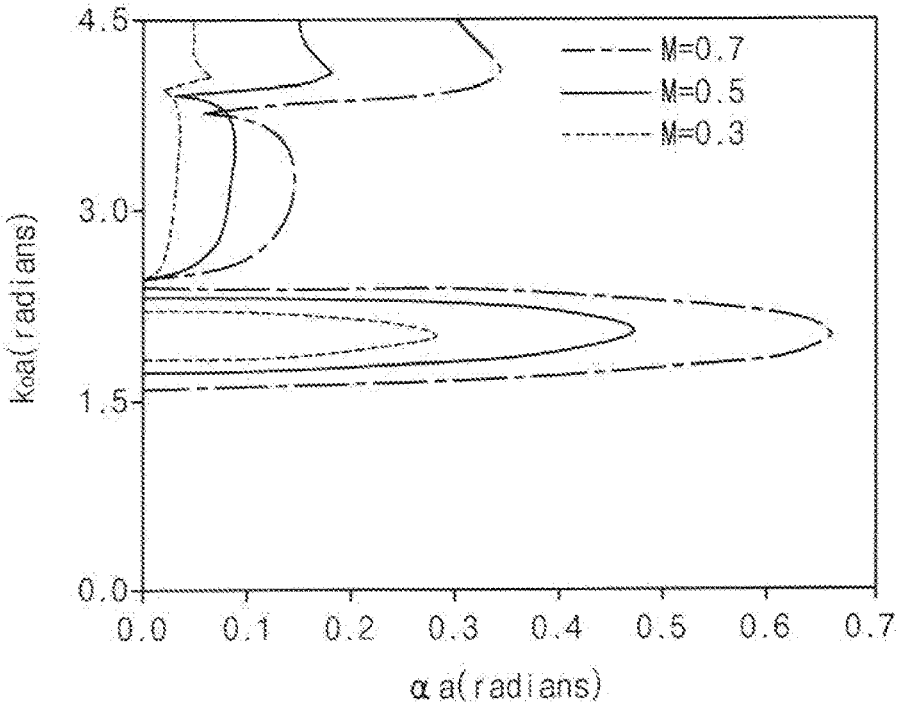

FIG. 9A and FIG. 9B show a dispersion relation on the SMAS and a change of the damping coefficient, when the mean surface admittance $\overline{Y}_x$=1.2 and each of the modulation factors M is 0.3, 0.5 and 0.7.

As illustrated in FIGS. 9A and 9B, as the modulation factor M increases, the leaking rate also increased so that a beam width is increased due to BM~a/$k_0$, but the radiation angle $\theta=\sin^{-1}(\beta/ko)$ is almost same. Thus, the phase constant β and the damping coefficient α may be independently controlled by changing the modulation profile.

Accordingly, in the directional sound apparatus 1 according to the present example embodiment, the radiation direction and the beam width may be independently controlled by designing the wave shape formed by the plurality of grooves.

Thus, in the directional sound wave according to the present example embodiment, the plurality of grooves formed on the planar shape plate 10 is formed to be a concentric circle shape with the sound wave generator 20 disposed in the center thereof. Here, as explained above, FIG. 2 merely shows the half of the circular planar shape plate for illustrating the position of the sound wave generator 20.

Figure 10A:
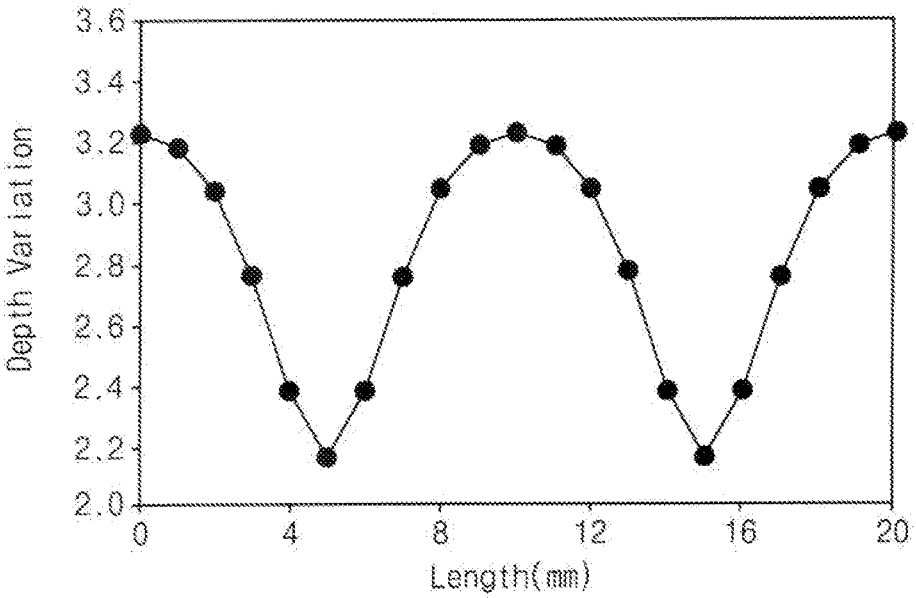
FIG. 10A and FIG. 10B show simulation results of the directional sound apparatus when an omnidirectional sound source is applied on the surface of the planer shape plate.
Figure 10B:
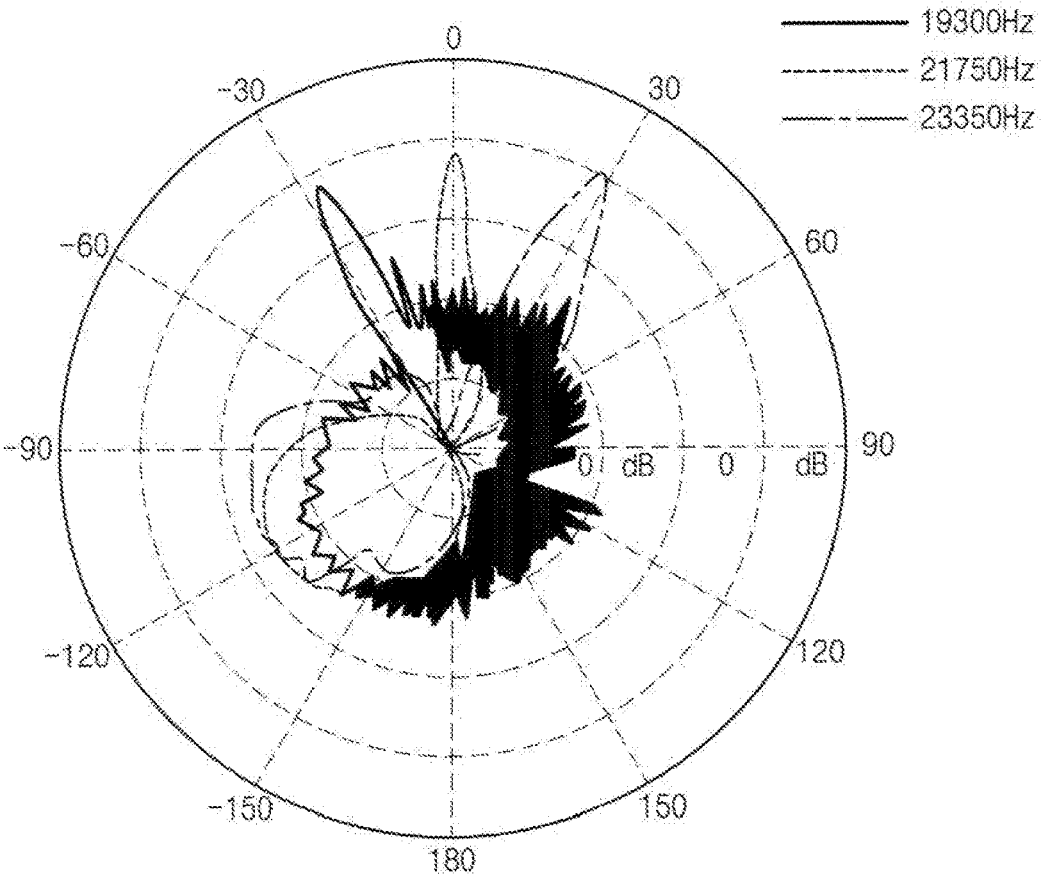

FIG. 10A and FIG. 10B show simulation results of the directional sound apparatus when an omnidirectional sound source is applied on the surface of the planer shape plate.

To verify the sound directional radiation characteristics of the sinusoidal modulated along the X direction in FIG. 5, a finite element method (FEM) simulation is performed as illustrated in FIG. 10A and FIG. 10B.

In the FEM simulation, a planar SMAS surface with $\overline{Y}_x$=1.2, M=0.5 at a designed frequency of k0a~4.02 performing the vertical radiation on the surface, is used. 240 grooves (p=0.1a, w=0.05a, a=10 mm) having a changed depth as illustrated in FIG. 10*a* are formed, for the bottom surfaces of the grooves adjacent to each other to from the wave shape. In addition, the omnidirectional point sound source is used.

As illustrated in FIG. 10*b*, from the FEM simulation results, a vertical direction (broadside) sound beam forming is formed on the surface having the directing or orienting around 21,750 Hz ($k_0a$~4.02). The designed structure has the frequency dispersion characteristics, and thus a reverse direction radiation of −30° at 19,300 Hz ($k_0a$~3.360) and a forward direction radiation of 30° at 23,350 Hz ($k_0a$~4.392) are obtained. Accordingly, as expected, the surface wave is generated along the direction of the surface of the structure.

Figure 11:
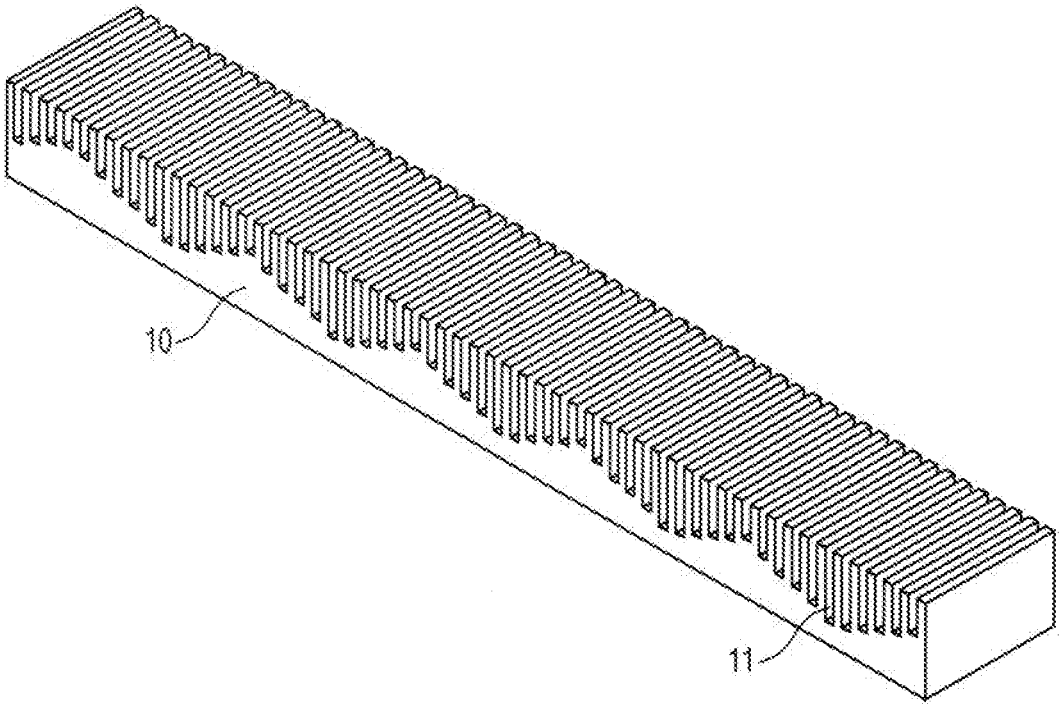
FIG. 11 is a perspective view illustrating a directional sound apparatus having a planar shape plate according to another example embodiment of the present invention.
Figure 12A:
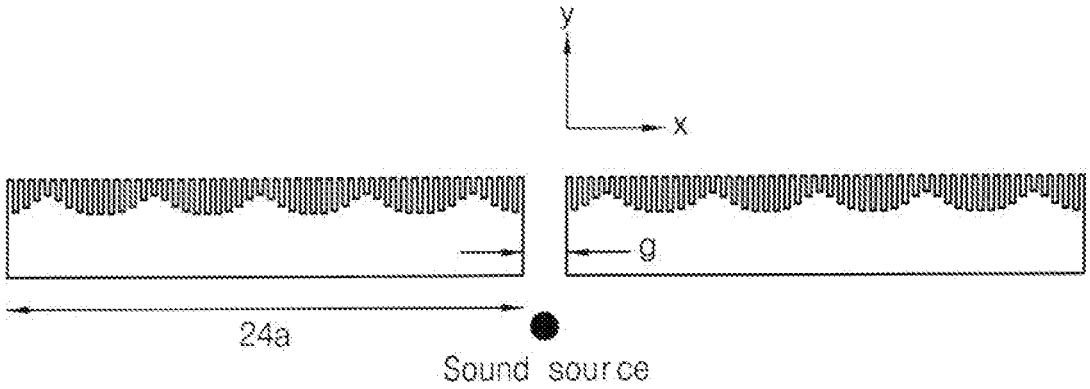
FIG. 12A, FIG. 12B, FIG. 12C, FIG. 12D and FIG. 12E shows experimental results of the directional sound apparatus of FIG. 11.
Figure 12B:
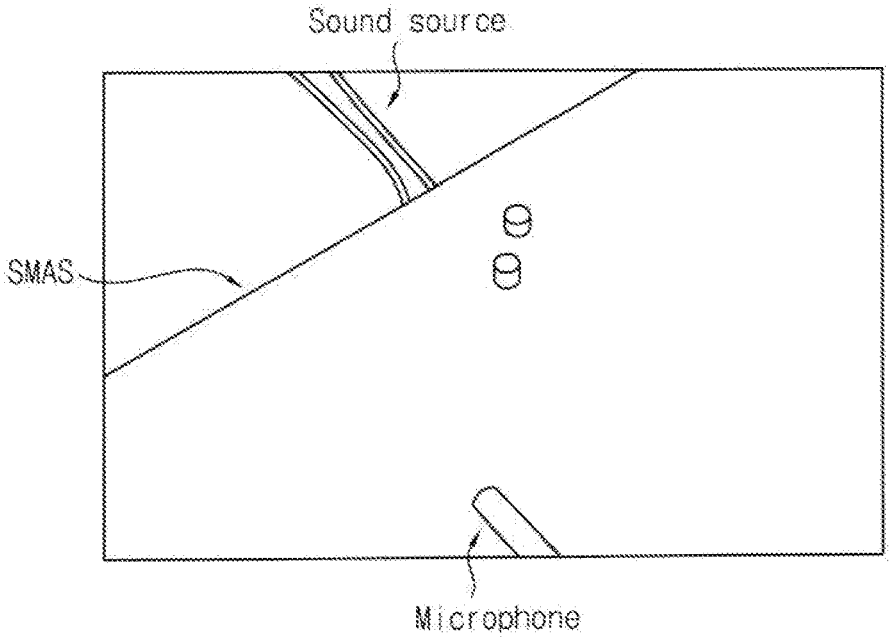
Figure 12C:
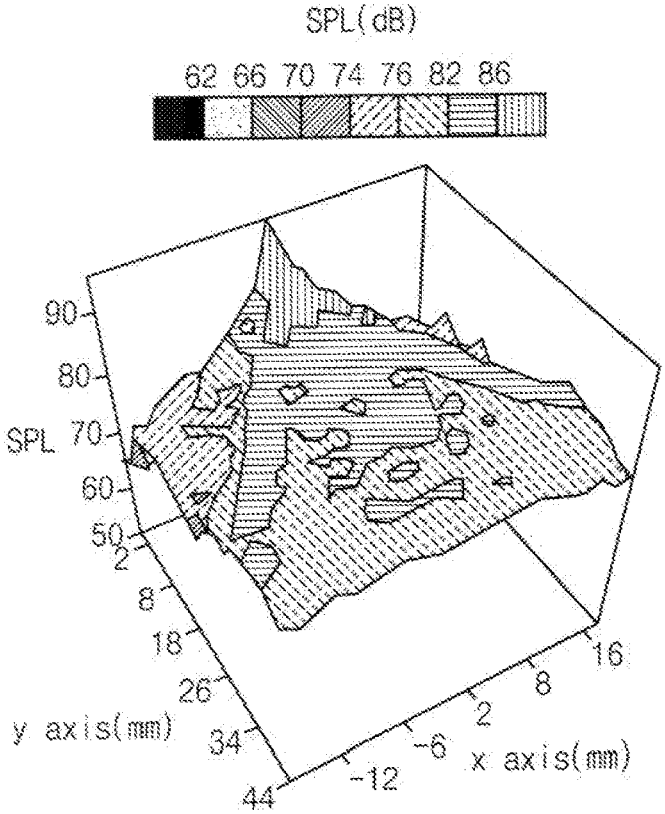
Figure 12D:
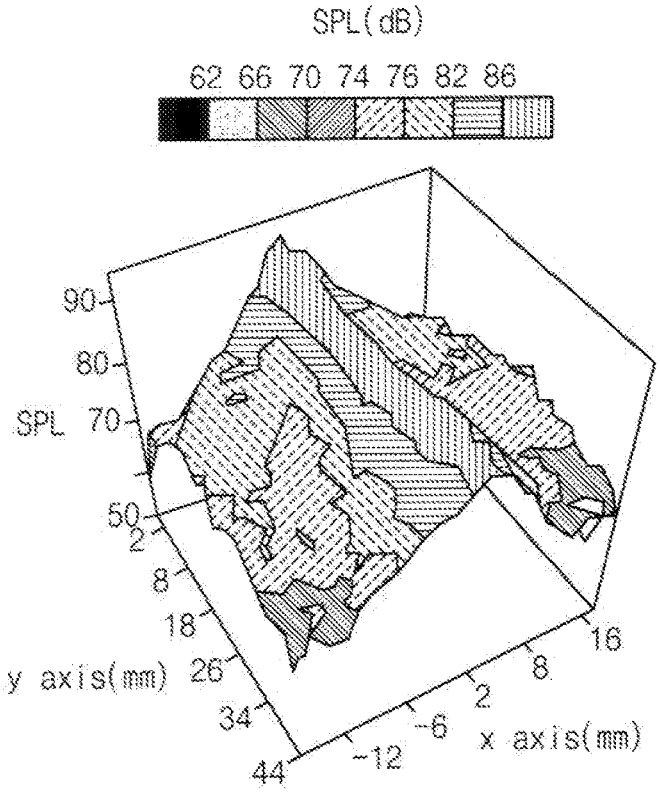
Figure 12E:
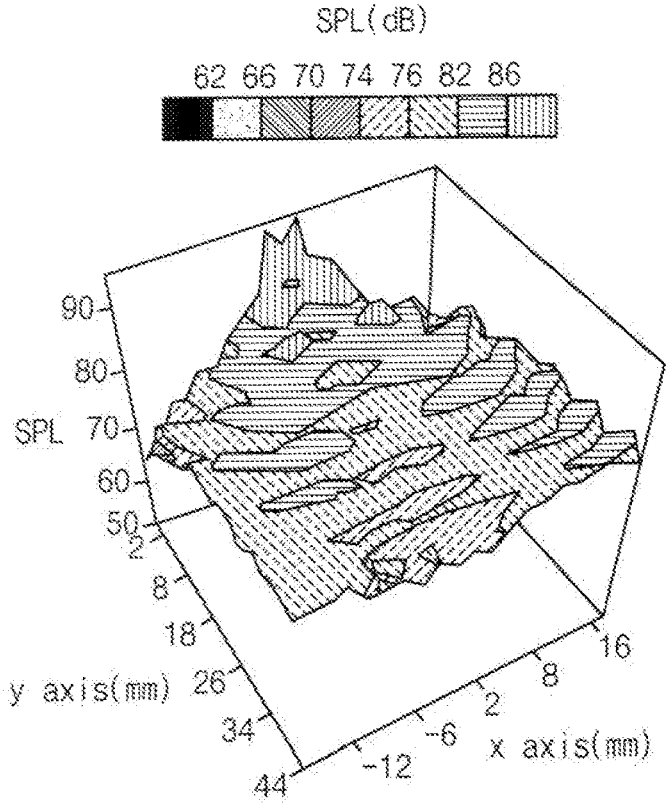

FIG. 11 is a perspective view illustrating a directional sound apparatus having a planar shape plate according to another example embodiment of the present invention.

In the directional sound apparatus according to the present example embodiment, as illustrated in FIG. 11, the plurality of grooves formed on the planar shape plate 10 is disposed or formed like a parallel line shape with respect to the sound wave generator 20.

Here, the admittance Y of the sinusoidal modulated admittance surface is $$Y = j\overline{Y}_x Y_o\left[1 + M\cos\left(\frac{2\pi x}{a}\right)\right]$$

along the X direction. To perform the surface physically, the surface of the planar shape plate is divided by a plurality of cell areas, and the surface admittance of each of the cell areas is combined, for the surface of the planar plate to form sinusoidal modulated admittance surface. For example, the surface admittance Y of each cell area along the X direction corresponding to each groove, $$Y = jY_0\frac{w}{p}\tan(k_0 d),$$

and here, wherein $\overline{Y}_x$ is a mean constant value of a surface admittance, $Y_o$ is a surface admittance of adjacent material, 'M' is a modulation factor, 'a' is a period of modulation, '$k_0$' is the number of waves in a free space, 'x' is a position on the surface, 'w' is a width of the groove, 'p' is a distance between the grooves, and 'd' is a depth of the groove.

FIG. 12A, FIG. 12B, FIG. 12C, FIG. 12D and FIG. 12E shows experimental results of the directional sound apparatus of FIG. 11.

To verify the sound radiation characteristics of the directional sound apparatus according to the present example embodiment in FIG. 11, the sound scanning experiments are performed as illustrated in FIGS. 12A, FIG. 12B, FIG. 12C, FIG. 12D and FIG. 12E. To perform the radiation vertical to the surface, the planar SMAS surface with Yx=1.2 and M=0.5 at the designed frequency of $k_0a$~4.02 is used. To form the bottom surface of the grooves adjacent to each other as the wave shape, 240 grooves (p=0.1a, w=0.05a, a=10 mm) having a changed depth are formed. In addition, the omnidirectional point sound source is used.

As the sound scanning experimental results, a vertical direction (broadside) sound beam forming having a relatively high directing or orienting around 21,750 Hz ($k_0a$~4.02) was obtained. The radiation of −30° was obtained at a relatively lower frequency of 19,300 Hz ($k_0a$~3.360) and the radiation of 30° was obtained at a relatively higher frequency of 23,350 Hz ($k_0a$~4.392). Accordingly, as expected, the surface wave is generated along the direction of the surface of the structure, and the surface wave is dispersed as a long distance along a specific direction.

Figure 13:
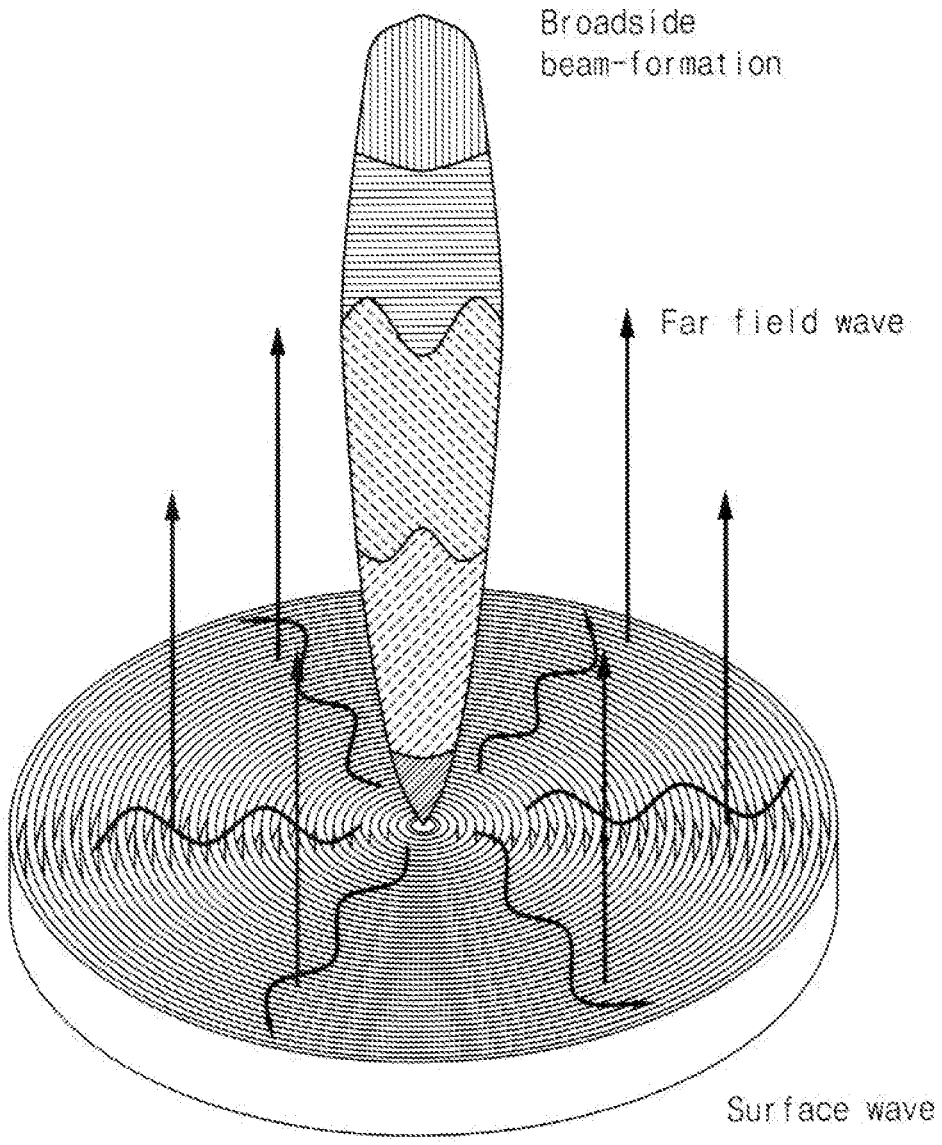
FIG. 13 is an image showing a radiation of the surface wave along a vertical direction in a leaking mode, due to a sinusoidal modulated surface of a circular plate along a radial direction; and FIG. 14A, FIG. 14B, FIG. 14C, FIG. 14D
Figure 14A:
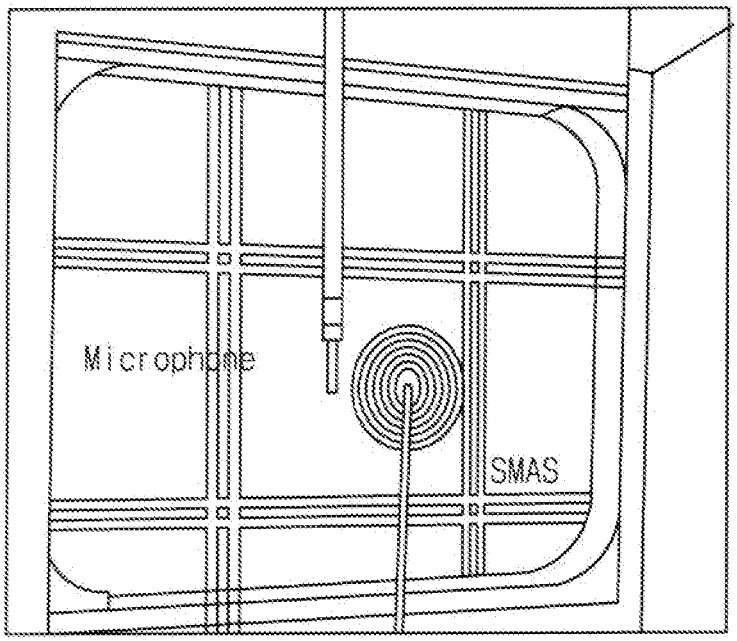
FIG. 14E shows experimental results of sound radiation of the sinusoidal modulated surface of the circular plate.
Figure 14B:
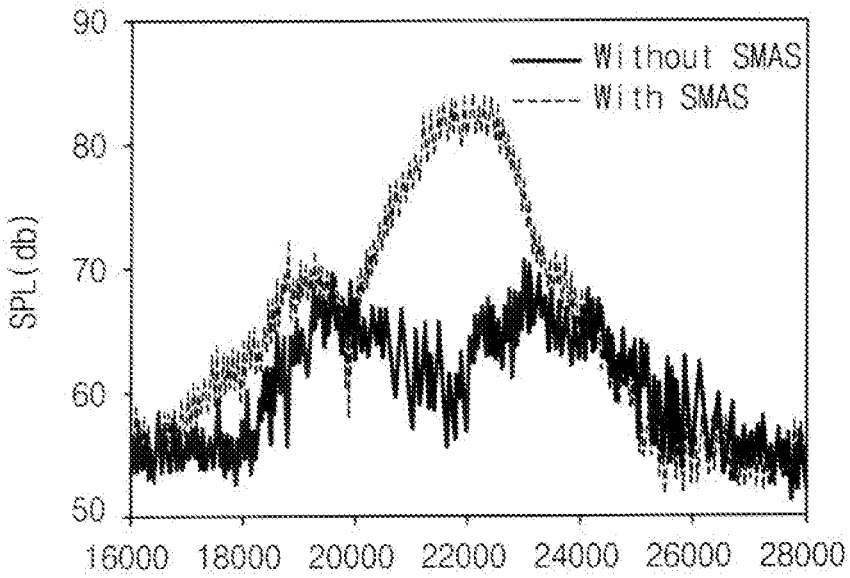
Figure 14C:
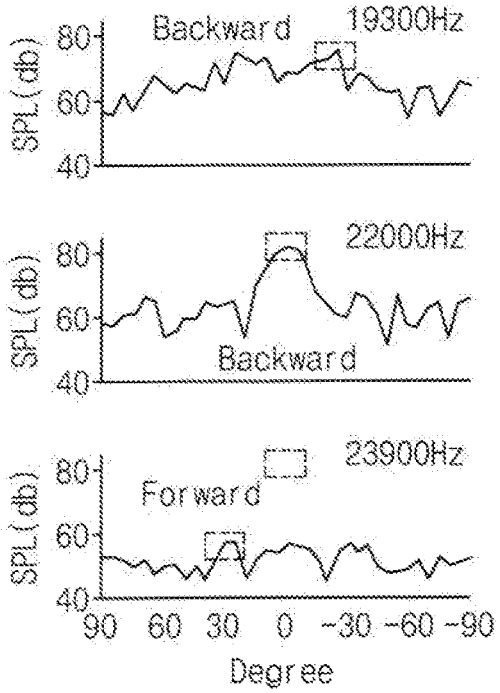
Figure 14D:
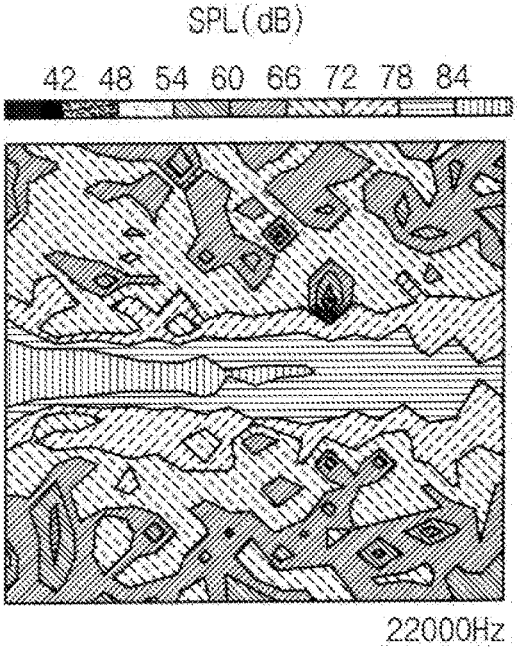
Figure 14E:
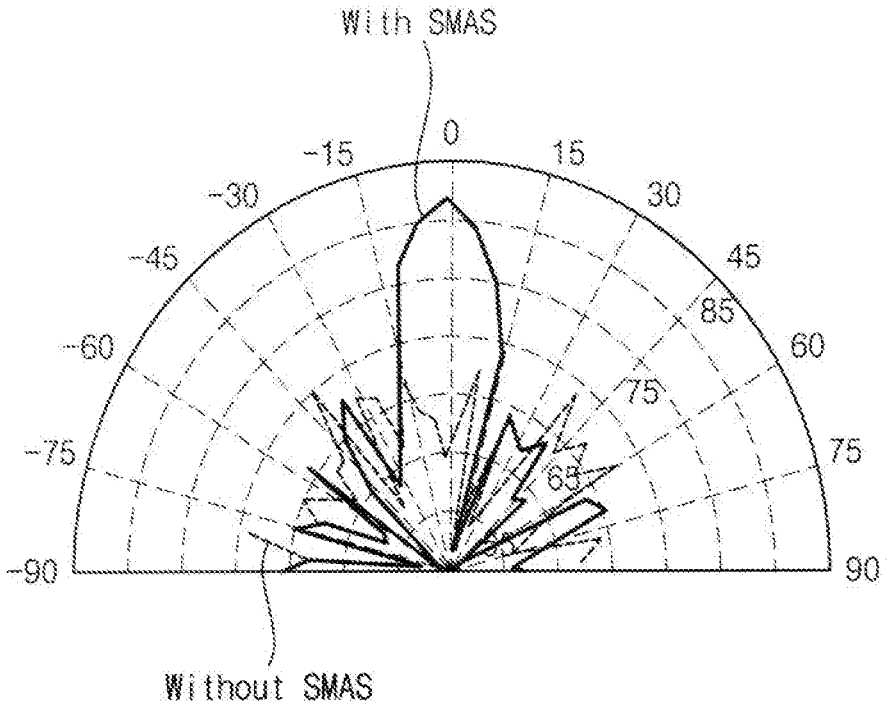

FIG. 13 is an image showing a radiation of the surface wave along a vertical direction in a leaking mode, due to a sinusoidal modulated surface of a circular plate along a radial direction.

As shown in FIG. 13, the surface wave is generated at the circular pattern having the sinusoidal modulated admittance surface along the radial direction as illustrated in FIG. 2, the beam in which the surface wave is vertically radiated on the surface at a specific frequency is illustrated.

FIG. 14A, FIG. 14B, FIG. 14C, FIG. 14D and FIG. 14E shows experimental results of sound radiation of the sinusoidal modulated surface of the circular plate.

In FIG. 14A, FIG. 14B, FIG. 14C, FIG. 14D and FIG. 14E, the beam is radiated with a 3-dimensional pencil shape due to the circular type sinusoidal modulated surface. Due to the sound leaking wave on the surface, a sound signal gain may be obtained in the frequency range between 19,000 Hz and 23,000 Hz. Due to the vertical direction radiation mode around $k_0a$~4.02, a very narrow sound beam forming which has a maximum SPL gain at the frequency range of about 22 kHz may be obtained.

According to the present example embodiments of the directional sound apparatus, the structures or the shapes of the grooves are designed such that the surface of the planar shape plate having the plurality of grooves is formed to have the mathematically sinusoidal modulated admittance surface. Thus, the surface wave is converted into a long distance radiation wave along the specific direction, and the directional sound beam having a relatively high gain may be formed.

Here, by designing the wave shape, the radiation direction and the width of the beam are independently designed, and the directional sound apparatus may be optimally designed to have high performance according the frequency band of the sound wave.

Having described the example embodiments of the present invention and its advantage, it is noted that various changes, substitutions and alterations can be made herein without departing from the spirit and scope of the invention as defined by appended claims.

What is claimed is:

1. A directional sound apparatus comprising:

a planar shape plate having a plurality of grooves formed on a surface thereof; and a sound wave generator configured to radiate a sound wave to outside from the surface of the planar shape plate;

wherein a width of each of the grooves and a distance between the grooves adjacent to each other are smaller than a wavelength of the sound wave, wherein the planar shape plate has a plurality of cell areas in which at least one groove is included, wherein a structure of the groove included in a first cell area is different from that of the groove included in a second cell area adjacent to the first cell area, so that surface admittance in the first cell area is different from that in the second cell area, wherein a depth of the groove included in the first cell area is different from that of the groove included in the second cell area adjacent to the first cell area, wherein a distance between the grooves adjacent to each other is substantially same as a width of the groove, and wherein central points of the grooves on a bottom surface are connected to form a curve having a repeated uniform period.

2. The directional sound apparatus of claim 1, wherein the curve is concaved from a surface of the planar shape plate, and has a repeated wave shape.

3. The directional sound apparatus of claim 1, wherein the surface admittance in each of the cell areas is defined as a normal particle velocity on the surface with respect to a pressure of a sound source on the surface of each of the cell areas.

4. The directional sound apparatus of claim 3, wherein admittance of the sinusoidal modulated admittance surface is defined as follows, $$Y = j\overline{Y}_x Y_o\left[1 + M\cos\left(\frac{2\pi x}{a}\right)\right]$$

wherein a surface admittance in each cell area is defined as follows, $$Y = jY_0\frac{w}{p}\tan(k_0 d)$$

wherein $\overline{Y}_x$ is a mean constant value of a surface admittance, $Y_o$ is a surface admittance of adjacent material, 'M' is a depth of modulation, 'a' is a period of modulation, '$k_0$' is the number of waves in a free space, 'x' is a position on the surface, 'w' is a width of the groove, 'p' is a distance between the grooves, 'd' is a depth of the groove, and 'j' is an imaginary unit of a complex number.

5. The directional sound apparatus of claim 1, wherein the grooves are disposed with a concentric circle shape with respect to the sound wave generator.

6. The directional sound apparatus of claim 1, wherein the grooves are disposed with a parallel line shape, and the sound wave generator is disposed at a central area among the grooves.

7. The directional sound apparatus of claim 1, further comprising:

a sound wave receiver configured to receive a sound wave incident to the surface of the planar shape plate from outside.

8. A directional sound apparatus comprising:

a planar shape plate having a plurality of grooves formed on a surface thereof; and a sound wave generator configured to radiate a sound wave to outside from the surface of the planar shape plate;

wherein a width of each of the grooves and a distance between the grooves adjacent to each other are smaller than a wavelength of the sound wave, wherein the planar shape plate has a plurality of cell areas in which at least one groove is included, wherein a structure of the groove included in a first cell area is different from that of the groove included in a second cell area adjacent to the first cell area, so that surface admittance in the first cell area is different from that in the second cell area, and wherein a width of the groove included in the first cell area is different from that of the groove included in the second cell area adjacent to the first cell area.

9. A directional sound apparatus comprising:

a planar shape plate having a plurality of grooves formed on a surface thereof; and a sound wave generator configured to radiate a sound wave to outside from the surface of the planar shape plate;

wherein a width of each of the grooves and a distance between the grooves adjacent to each other are smaller than a wavelength of the sound wave, wherein the planar shape plate has a plurality of cell areas in which at least one groove is included, wherein a structure of the groove included in a first cell area is different from that of the groove included in a second cell area adjacent to the first cell area, so that surface admittance in the first cell area is different from that in the second cell area, and wherein a distance between the grooves adjacent to each other in the first cell area, is different from that between the grooves adjacent to each other in the second cell area.

* * * * *